United States Patent [19]

Karayannis

[11] 4,044,682

[45] Aug. 30, 1977

[54] IGNITION CURRENT GENERATOR FOR AN ELECTRICAL PROJECTILE FUZE

[75] Inventor: Panayotis Karayannis, Zurich, Switzerland

[73] Assignee: Werkzeugmaschinenfabrik Oerlikon-Buhrle AG, Zurich, Switzerland

[21] Appl. No.: 637,639

[22] Filed: Dec. 4, 1975

[30] Foreign Application Priority Data

Dec. 6, 1974 Switzerland ..... 16212/74

[51] Int. Cl.[2] ..... F42C 11/04; F42B 9/00; F42C 9/00; F42C 19/12

[52] U.S. Cl. ..... 102/70.2 GA; 102/18 R

[58] Field of Search ..... 102/70.2 G, 70.2 GA, 102/70.2 I

[56] References Cited

U.S. PATENT DOCUMENTS

| | | | |
|---|---|---|---|
| 2,820,411 | 1/1958 | Park | 102/70.2 G |
| 2,977,881 | 4/1961 | Piper | 102/70.2 G |

FOREIGN PATENT DOCUMENTS

| | | | |
|---|---|---|---|
| 767,259 | 4/1952 | Germany | 102/70.2 G |
| 525,333 | 8/1940 | United Kingdom | 102/70.2 G |

*Primary Examiner*—Verlin R. Pendegrass
*Assistant Examiner*—Thomas H. Webb
*Attorney, Agent, or Firm*—Werner W. Kleeman

[57] ABSTRACT

An ignition current generator for an electrical projectile fuze comprising a soft iron ring which, viewed in the direction of the projectile, is secured at the rear end face of a substantially ring-shaped permanent magnet which is axially displaceable. The permanent magnet, in a first position thereof, surrounding an induction coil and bearing with its front end face or surface against a flange of a soft iron core. This soft iron core is provided at its outer circumference with a groove in which there is located the induction coil. The stroke of the permanent magnet is of a size such that in a second position of the permanent magnet the induction coil is located externally of the magnetic field produced by the permanent magnet, and the permanent magnet also in its second position is located upon the soft iron core.

2 Claims, 1 Drawing Figure

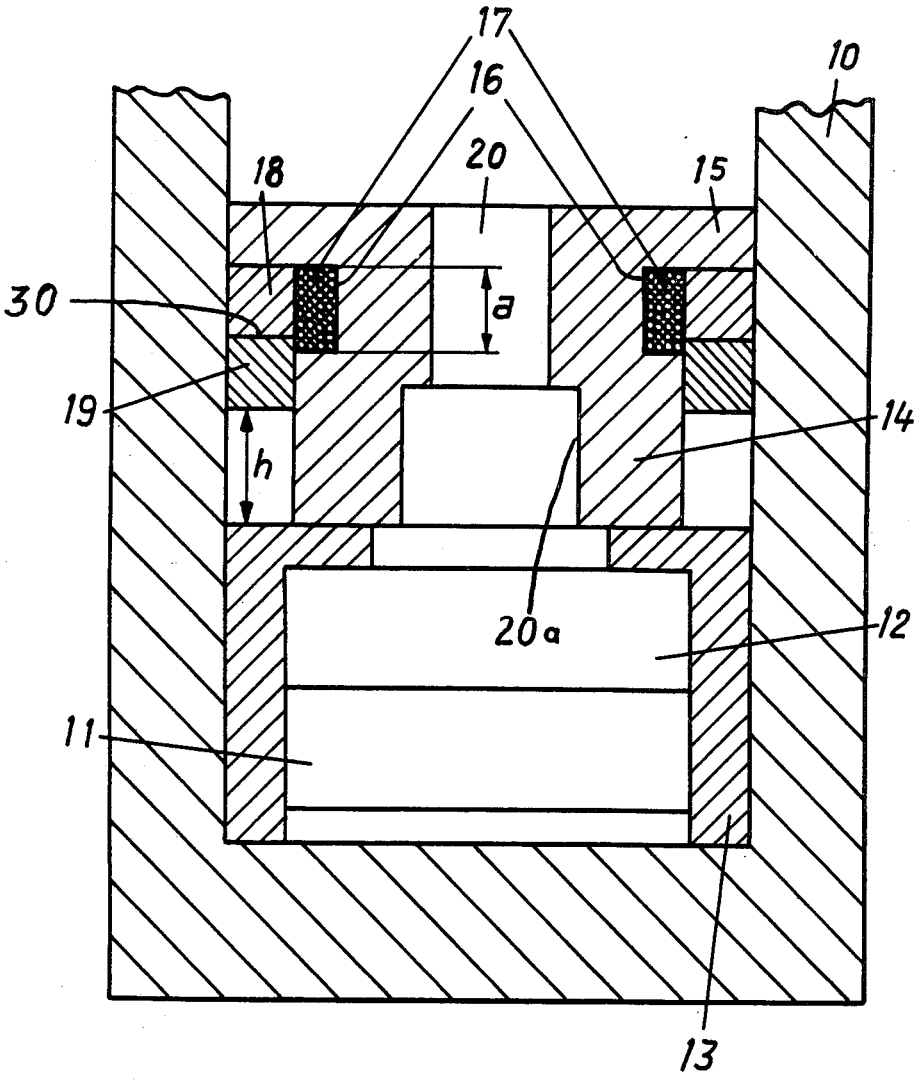
17
16
10
18
20
15
30
a
19
14
h
20a
12
11
13

IGNITION CURRENT GENERATOR FOR AN ELECTRICAL PROJECTILE FUZE

BACKGROUND OF THE INVENTION

The present invention relates to a new and improved construction of firing or ignition current generator for an electrical projectile fuze of the type comprising a soft iron core which is arranged substantially coaxially with respect to the projectile axis, an induction coil surrounding the soft iron core, a substantially ring-shaped permanent magnet which is arranged to be axially displaceable, the permanent magnet, when in a first position, surrounding the induction coil.

An ignition current generator of this type is already known to the art which, however, in relation to its size is only capable of generating very little electrical energy.

SUMMARY OF THE INVENTION

Hence, it is a primary object of the present invention to provide an improved construction of ignition current generator for an electrical projectile fuze which is not associated with the aforementioned drawbacks and limitations of the prior art constructions.

Another and more specific object of the present invention aims at providing a new and improved construction of an ignition current generator which with as small as possible dimensions delivers a maximum amount of electrical energy, i.e., the generated electrical energy should be as great as possible per unit volume of the apparatus.

Still a further object of this invention aims at a novel construction of ignition current generator which while compact in size delivers a considerable amount of electrical energy.

In order to realize the above objectives it is necessary to bring about a large change of the magnetic flux penetrating the induction coil, so that there is produced a large induced current which can be beneficially employed for charging a capacitor.

Now in order to implement the foregoing objects and others which will become more readily apparent as the description proceeds, the invention contemplates that a soft iron ring, viewed in the direction of the projectile, is secured at the rear end face of the ring-shaped permanent magnet, the soft iron core possesses a flange at which there bears the permanent magnet with its front end face or surface when such permanent magnet is in its first position. Further, the soft iron core is provided at its outer periphery with a groove in which there is located the induction coil. The stroke of the permanent magnet is so large that in a second position of the permanent magnet the induction coil is located externally of the magnetic field produced by the permanent magnet, and that the permanent magnet also in its second position is located upon the soft iron core.

Due to this arrangement there is realized a considerable change in the magnetic flux in that the induction coil is initially surrounded by a first closed magnetic circuit which is subsequently opened and shifted adjacent the induction coil i.e. there is formed a second closed magnetic circuit spaced from the first closed magnetic circuit, so that the magnetic flux through the induction coil can drop from a maximum value to null.

BRIEF DESCRIPTION OF THE DRAWING

The invention will be better understood and objects other than those set forth above, will become apparent when consideration is given to the following detailed description thereof. Such description makes reference to the annexed drawing wherein in the single FIGURE there is schematically illustrated in fragmentary sectional view part of an electrical fuze.

DETAILED DESCRIPTION OF THE PREFERRED EMBODIMENTS

Describing now the drawing, it is to be understood that for the sake of simplicity in illustration only enough of the details of the projectile fuze have been shown to enable those skilled in the art to readily understand the underlying concepts of the present invention which is specifically directed to the improved firing or ignition current generator for an electrical projectile fuze. Turning attention to the FIGURE, there will be recognized a projectile body 10 having a lengthwise extending projectile axis and in which there is arranged a sleeve 13 or equivalent structure housing a conventional electronic control device 11 and an energy storage means, typically for instance a capacitor 12. In order to charge the capacitor 12 there is provided a current generator possessing a core 14 formed of soft iron which is secured by means of its flange 15 defining a contact surface in any suitable manner at the projectile body 10. The core 14 contains within a peripheral groove or recess 16 an induction coil 17. The groove 16 possesses a height or width *a.* Further, a substantially ring-shaped permanent magnet 18 and a soft iron ring 19 are displaceably arranged upon the soft iron core 14. The permanent magnet 18 and the soft iron ring 19 secured thereto can be displaced or moved out of a first position, through the distance *h,* into a second position. This displacement path of the permanent magnet 18 and the soft iron ring 19 is greater than the width or height *a* of the groove 16 provided for the induction coil or winding 17. The induction coil 17 is electrically connected in conventional manner with the capacitor 12. In this electrical circuit connection arrangement there can be incorporated a rectifier which prevents discharge of the charged capacitor 12 through the induction coil 17. Instead of the rectifier or rectifier arrangement there could be employed a switch which, following charging of the capacitor 12, renders possible interrupting the electrical connection between the induction coil 17 and the capacitor 12.

Further there is provided a switch which enables connecting the capacitor 12 with an electrical detonator cap 20 arranged in bore **20*a* in order to initiate detonation of the projectile. This switch either can be activated upon impact of the projectile at the target or by a timing relay which enables self-destruction or self-detonation of the projectile after the expiration of an adjustable period of time. There is additionally provided a further switch, for instance a centrifugal switch, which turns-on the timing relay at the start of rotation or spin of the projectile in order that the projectile can be exploded following the expiration of the set or adjusted time. Finally, there is provided a transport safety means or device which insures that the capacitor 12** cannot be charged during transport of the projectile due to an unintentional shock or blow which may be exerted at or applied to the projectile. The invention is not concerned with specific structures of rectifier arrangements, switches or safety devices, rather with the details of the ignition current generator for producing the electrical energy of the projectile fuze for detonating the projectile. A projectile fuze circuit arrangement employing a rectifier has been disclosed, by way of example, in the commonly assigned, copending United States application Ser. No. 571,977 of Walter Hurlimann, entitled "Projectile Fuse For A Spinning Projectile Containing A Detonator Cap And An Electromagnetic Firing Or Ignition Current Generator", to which reference may be readily had and the disclosure of which is incorporated herein by reference. Further, in my commonly assigned, copending United States application, Ser. No. 633,925, filed Nov. 20, 1975, and entitled "Safety Device For A Current Generator Used With An Electrical projectile Fuze" there are disclosed different constructions of possible safety devices for a projectile fuze, and equally the disclosure of which is incorporated herein by reference.

All of the components or parts of the described apparatus are constructed such that they are capable of withstanding an acceleration of the projectile in the order of magnitude of 40,000 to 100,000 times the acceleration due to gravity.

The permanent magnet 18 is preferably axially magnetized. A not particularly illustrated but conventional spring insures that the permanent magnet 18, prior to firing of the projectile, bears at the flange 15 of the core 14 formed of soft iron. The soft iron ring 19 is preferably adhesively bonded with the permanent magnet 18, as generally indicated by reference character 30 representing an adhesive interface. As the transport safety device there is preferably employed a so-called restraining or inhibiting element which first then renders possible a displacement or shifting of the permanent magnet 18 when both acceleration forces and also spin forces act upon the projectile. As above mentioned safety devices satisfying such purpose constitute subject matter of my aforementioned copending United States application.

Equally as explained above the drawing has been confined to the illustration of the components with which the invention is directly concerned in order to simplify the showing, and thus, the above mentioned switches, the transport safety device and details of the control device 11 have not been shown.

At this point there will now be considered the mode of operation of the firing or ignition current generator for the electrical projectile fuze as constituted by the present invention, and the same is as follows: When the projectile, upon firing thereof, is accelerated in axial direction and in its direction of spin, the timing relay is switched-on and also the transport safety device is rendered ineffectual, so that the permanent magnet 18 and the soft iron ring 19 can shift, under the action of the inertia forces acting thereat, out of the position illustrated in the drawing through the displacement path *h*. This displacement of the permanent magnet 18 and the soft iron ring 19 brings about a change in the magnetic flux surrounding the induction coil 17, so that a current is induced in the induction coil 17 which charges the capacitor 12. The charged capacitor 12 is, however, first connected via a contact with the electrical detonator cap when the contact is either actuated by the timing relay or by virtue of the impact of the projectile. The control device 11 can be however constructed such that a detonation of the projectile is first possible when both the time of the timing relay has expired and the projectile has arrived at the target.

Preferably a second soft iron ring can be secured at the end face or surface of the permanent magnet 18 which is opposite the soft iron ring 19. Due to this measure there is achieved the advantageous result that already with a relatively small stroke *h* the induction coil 17 is located outside of the magnetic field generated by the permanent magnet 18 since such is short-circuited by the soft iron ring.

While there are shown and described present preferred embodiments of the invention, it is to be distinctly understood that the invention is not limited thereto, but may be otherwise variously embodied and practiced within the scope of the following claims. Accordingly,

What is claimed is:

1. An ignition current generator for an electrical projectile fuze of a projectile having a lengthwise extending axis comprising in combination:

a. a soft iron core arranged substantially coaxially with respect to the projectile axis;

b. an induction coil surrounding the soft iron core;

c. a substantially ring-shaped permanent magnet having front and rear end faces and arranged to be axially displaceable between a first position and a second position, said ring-shaped permanent magnet surrounding the induction coil when in its first position to close a first magnetic circuit;

d. a soft iron ring which, viewed in the direction of the projectile, is secured at said rear end face of said ring-shaped permanent magnet;

e. said soft iron ring being secured at said rear end face of said ring-shaped permanent magnet in that said ring-shaped permanent magnet and said soft iron core are mutually bonded to one another;

f. said soft iron core possessing a flange at which bears said substantially ring-shaped permanent magnet with said front end face thereof when in its first position for closing said first magnetic circuit;

g. said soft iron core being provided at its periphery with a groove, said induction coil being located in said groove;

h. said soft iron core possessing an outer substantially cylindrical surface;

i. said substantially ring-shaped permanent magnet having a substantially inner cylindrical surface; and j. said substantially ring-shaped permanent magnet, when in said second position, bearing by means of said inner cylindrical surface at said outer cylindrical surface at a location spaced from said induction coil in order to close a second magnetic circuit spaced from said first magnetic circuit.

2. The ignition current generator as defined in claim 1, further including detonator means arranged in said soft iron core.

* * * * *